US007476799B2

(12) United States Patent
Purchon et al.

(10) Patent No.: US 7,476,799 B2
(45) Date of Patent: Jan. 13, 2009

(54) SOUND-EFFECT FOOT PEDAL FOR ELECTRIC/ELECTRONIC MUSICAL INSTRUMENTS

(76) Inventors: Jeffrey Howard Purchon, 9 Baxter Rd., Acton, MA (US) 01720; Bruce Franklin Ritz, 19 Lawrence Rd., Wellesley, MA (US) 02482-4715

( * ) Notice: Subject to any disclaimer, the term of this patent is extended or adjusted under 35 U.S.C. 154(b) by 531 days.

(21) Appl. No.: 11/176,974

(22) Filed: Jul. 7, 2005

(65) Prior Publication Data

US 2006/0011052 A1 Jan. 19, 2006

Related U.S. Application Data

(60) Provisional application No. 60/585,894, filed on Jul. 7, 2004, provisional application No. 60/644,892, filed on Jan. 18, 2005.

(51) Int. Cl.
*G05G 1/14* (2006.01)
*G10H 1/00* (2006.01)

(52) U.S. Cl. ..... 84/746; 84/701; 84/694

(58) Field of Classification Search ..... 84/746, 84/626, 629, 631, 662, 664, 701, 708, 694; *G05G 1/14*
See application file for complete search history.

(56) References Cited

U.S. PATENT DOCUMENTS

| | | | | | |
|---|---|---|---|---|---|
| 2,986,953 | A | * | 6/1961 | De Armond et al. | 74/478 |
| 3,974,461 | A | | 8/1976 | Luce | 332/17 |
| 4,106,384 | A | | 8/1978 | Whittington et al. | 84/1.19 |
| 4,144,790 | A | * | 3/1979 | Suchoff | 84/708 |
| 4,205,579 | A | * | 6/1980 | Kakehashi | 84/708 |
| 4,236,434 | A | | 12/1980 | Nishibe | 84/1.19 |
| 4,384,505 | A | * | 5/1983 | Cotton et al. | 84/708 |
| 4,631,033 | A | * | 12/1986 | Menne | 440/7 |
| 4,631,034 | A | * | 12/1986 | Menne et al. | 440/7 |
| 4,649,785 | A | | 3/1987 | Chapman | 84/1.19 |
| 4,939,501 | A | * | 7/1990 | Weil | 338/153 |
| 5,243,658 | A | * | 9/1993 | Sakata | 381/62 |
| D345,756 | S | * | 4/1994 | Clothier | D17/20 |
| 5,659,145 | A | * | 8/1997 | Weil | 84/464 R |
| D391,923 | S | * | 3/1998 | Tracey | D13/167 |
| 5,739,452 | A | * | 4/1998 | Nagata | 84/610 |
| 5,741,992 | A | * | 4/1998 | Nagata | 84/631 |
| 5,789,689 | A | * | 8/1998 | Doidic et al. | 84/603 |

(Continued)

OTHER PUBLICATIONS

Author Unknown, Tone Frenzy Presents, Ibanez Flying Pan, Date Unknown, 3 Pages.

(Continued)

*Primary Examiner*—David S. Warren

(57) ABSTRACT

The CHOPPER has a unique treadle design which allows a better utilization of space in order to accommodate the control functions in a compact foot-pedal sound effect. In the case of the CHOPPER, the space is required to allow the multiple control functions required to achieve delay (echo) emulation, which is a new and unique sound effect generated by this product. The sound effect is controlled by means of a foot treadle that can uniquely control multiple parameters. The rate at which the foot treadle controls the effect is by means of a specific and unique optical coupling. To enable precise control of the effect, there is a visible read out of the modulation frequency which has not been achieved before in a foot pedal. Further, the modulation frequency can be controlled by a MIDI sync code which is also unique in a foot-pedal format.

20 Claims, 13 Drawing Sheets

U.S. PATENT DOCUMENTS

| | | | | | |
|---|---|---|---|---|---|
| D405,461 | S | * | 2/1999 | Excellente | D17/99 |
| 5,902,951 | A | * | 5/1999 | Kondo et al. | 84/610 |
| 5,977,474 | A | * | 11/1999 | O'Brien | 84/735 |
| 5,978,045 | A | * | 11/1999 | Mercs | 348/578 |
| 5,981,862 | A | * | 11/1999 | Geier, Jr. | 84/746 |
| 6,664,460 | B1 | * | 12/2003 | Pennock et al. | 84/662 |
| 6,881,891 | B1 | * | 4/2005 | Limacher et al. | 84/662 |
| 6,998,528 | B1 | * | 2/2006 | Limacher et al. | 84/662 |
| 7,005,571 | B1 | * | 2/2006 | Groff | 84/645 |
| 7,026,539 | B2 | * | 4/2006 | Pennock et al. | 84/662 |
| 2004/0159222 | A1 | * | 8/2004 | Pennock et al. | 84/662 |
| 2004/0163528 | A1 | * | 8/2004 | Ludwig | 84/645 |
| 2006/0011052 | A1 | * | 1/2006 | Purchon et al. | 84/746 |
| 2006/0287855 | A1 | * | 12/2006 | Cernasov | 704/248 |

OTHER PUBLICATIONS

R.G. Keen, Guitar Effects FAQ, May 20, 2000, 2 Pages.
Author Unknown, Effects Descriptions, Date Unknown, 6 Pages.
Author Unknown, Ibanez Weeping Demon Electronics WD-7, Date Unknown, 3 Pages.
Author Unknown, Dunlop Univibe, Date Unknown, 3 Pages.
Author Unknown, Rorotvibe, Date Unknown, 2 Pages.
Author Unknown, Electro-Harmonics Pulsar, Date Unknown, 1 Page.
Author Unknown, Dejavibe2 and tremulous Bear, Date Unknown, 1 Page.
Author Unknown, Boss Tr-2, Date Unknown, 1 Page.
Author Unknown, Boss PH-3, Date Unknown, 1 Page.
Author Unknown, Boss AW-3, Date Unknown, 1 Page.
Author Unknown, More Effects Pedals—Boss PN-2, Dunlop TVP-1, Dunlop TS-1, and Ernie Ball 6165, Date Unknown, 3 Pages.
Author Unknown, Ebay Auction Boss PN-2, Date Unknown, 2 Pages.
Scott Lehman, Harmony Central—Chorus, 1996, 5 Pages.
Scott Lehman, Harmony Central—Flanging, 1996, 6 Pages.
Ken Westover, 01/W Panning, Oct. 14, 2000, 4 Pages.
Craig Anderton, The Wide World of Panning, Date Unknown, 2 Pages.
Author Unknown, T.I.P. 3rd Hand, Date Unknown, 2 Pages.

* cited by examiner

SOUND-EFFECT FOOT PEDAL FOR ELECTRIC/ELECTRONIC MUSICAL INSTRUMENTS

RELATED APPLICATIONS

This application claims the benefit of U.S. Provisional Application Nos. 60/585,894, filed on Jul. 7, 2004 and 60/644,892, filed on Jan. 18, 2005. The entire teachings of the above applications are incorporated herein by reference.

BACKGROUND OF THE INVENTION

Musicians who play electronic instruments, such as electric guitars, use various electronic circuits to change or augment the sound. For example, a guitarist can add distortion to the sound to create an aggressive sound which has become very popular in rock music. By housing the distortion circuitry in a foot-operated pedal, the effect can be turned off and on during a performance leaving the hands free to play the instrument. The distortion foot pedal was among the first and simplest of all guitar effects processing devices and was an analog effect inserted between the guitar and the amplifier.

Subsequently, a variety of both analog and digital single effects have become available to the musician either as foot-operated pedals or rack-mounted signal processing devices. Typically, an electric guitarist will have several foot pedals, each turning on and off a different circuit creating a variety of sounds. Examplary effects provided by such devices include delays (echoes), tremolo's (amplitude vibrato), "wah-wah" (just like it sounds), reverb, and others. Such effects, pedals, and rack-mounted processors add variety in tonal possibilities and are used by many guitarists to provide a large variety of sounds.

SUMMARY OF THE INVENTION

In one aspect, the present invention includes a foot-operated pedal that solves at least two competing needs—one is to be compact and portable, and the other is to offer one or more control knobs and/or switches in combination with a foot-operated treadle to control the sounds. The treadle is configured to move up and down to control the sound, similar to the accelerator pedal of a car. Given that the treadle is foot operated, it preferably provides a profile that is well adapted to an operator's foot. That is, at least one dimension of the pedal (e.g., its length or width) sized according to a corresponding dimension of an operator's foot. If the control knobs were placed conventionally on top of the device and next to the treadle, the device would become quite large in comparison to other pedals and quite possibly too large for mounting on commonly-available floor pedal boards.

The solution is a uniquely-designed treadle that enables placement of both the treadle and one or more knobs upon a top surface of the device, while maintaining a compact profile. The physical shape of the foot treadle includes a solid platform to accommodate an operator's foot, while also providing a cut-out that harbors control knobs nestled within the space of the cutout. For example, one treadle design includes a compact 'I' shape. The 'I' shape creates a solid platform for a foot providing both longitudinal and lateral support, while the cutouts of the I provide space for any knobs. Thus, the overall space consumed on the top of the device is no more than the space occupied by normal treadle without sacrificing any of the additional control functions.

Such a treadle has not been used before in competing pedals. For example, the V-WAH available from BOSS Corporation of Hamamatsu, Japan is a large device providing control knobs at the end of the pedal. Such end placement unfortunately extends the overall length of the device. The WEEPING DEMON, available from Ibanez, a Hosino Gakki Group Company, Hoshino (USA) Inc., Bensalem, Pa. has a treadle with knobs disposed along the side, thus extending its width. The WEEPING DEMON treadle is slightly shaped, but unlike the present invention (referred to as the CHOPPER), no attempt has been made to allow the control knobs to nestle within the space the treadle alone takes up. As a consequence, the Ibanez product must be much wider.

In another aspect, the invention relates to delay, or echo, emulation. The Chopper is fundamentally a modulator. Modulators are not unique in the sound effect industry (various tremolo devices, and chorus pedals, etc. are available). The CHOPPER, however, is unique in that it modulates using at least two oscillating waves. Beneficially, the two oscillating waves can be different types of waves. For example, a first oscillating wave can be a square wave, whereas a second oscillating wave can be a different wave, such as a sine wave. The square wave generates a 'chop' sound; whereas, the sine wave generates a 'pan' or 'tremolo' sound, depending on whether it is configured in stereo or mono. Combining the two independent oscillators in various ways creates new and interesting sounds, which are referred to as 'delay emulation' because they produce a sound similar to that produced by an echo or tape delay. An echo, such as that produced by a tape loop or digital delay typically produces a sound combined with a delayed version of the same sound thereby producing the echo. Unlike an echo, however, there is no repeated note with the present invention.

In contrast to the echo or digital delay devices that allow for the same sound bite or note to be played over and over, the invention does not, by itself, generate any repeated notes. The sound or note desists when the player ceases to play that note. Beneficially, the chopped sound is applied to current notes and sounds as they pass through the device. The effect is also different than that provided by samplers, which record and repeat a specific note, similar to an echo. Further, because the device has stereo capability, the sound effects created are even more unique and captivating. These sounds and the means by which they are achieved is unique and is described in more detail later. It is believed that no other devices are available providing a similar sound effect. Most of the major effect pedal manufacturers offer delay (echo) pedals, but none offer a delay emulation pedal, and the sound is quite different in character.

The invention is also capable of controlling more than one modulation effects using a single variable control, such as a foot-operated treadle. The invention generates at least two independent oscillating waves. One can be a sine wave that provides a tremolo sound in a mono application. That is the amplitude of the sound is increased and decreased periodically according to the sine wave. When used in stereo, the device can produce a pan effect. In other words, as the left channel is attenuated, the right channel is gaining amplitude, such that the sound is perceived as moving from one channel to the other and back again according to the sine wave. If used in mono, this sounds like a tremolo unit. If used in stereo, it sounds like an 'auto pan.' What is unique in both cases however, is that the modulation frequency can be varied continuously by an on-board treadle (hands free) to allow the performer to emulate a rotating speaker effect, similar to that produced by actual rotating speaker cabinets, such as the Leslie speaker cabinets, or to add some interesting sounds not achievable before by other tremolo or modulation pedals.

Another pedal, referred to as a ROTOVIBE, manufactured by Dunlop Manufacturing Inc. of Benecia, Calif., provides a pedal mechanism to control the modulation frequency of its chorus effect called a "Leslie (rotating) emulator"; however, this works only in mono. By producing a similar sound effect using a stereo capability results in a far more compelling and authentic emulation of a rotating speaker sound. Further, if the two waves are combined (chop and pan) and subsequently adjusted by the treadle, distinct and unique stereo sounds can be generated never before heard in a sound effect pedal.

Some devices, such as the 3RD HAND manufactured by Tone In Progress of Santa Rosa, Calif., offer foot-pedal control mechanism for adjusting a single control using the foot-pedal. Thus, these types of devices allow a musician to attach the foot-pedal control to another foot pedal effect to vary a single parameter of that effect that would otherwise be adjustable using a control knob. In addition to the limitation of being ably to vary only a single control, such a 3RD HAND device represents a separate item that must be used in combination with the pedal effect being adjusted. The present invention is unique at least in that it allows for control over the specific sound effects described above using an on-board treadle rather than a separate device, and that it is capable of controlling at least two parameters at the same time. These features including controlling a stereo signal allow users to create with ease new and varied sounds in the process.

In some embodiments, the invention provides a display element, such as an LCD screen. The display can be used to identify one or more parameters or settings, such as providing a read-out display of the modulation frequency. The read out can be provided for one or both of the device's oscillators. Such a display allows the musician to repeatedly and accurately achieve one or more desired parameters, such as modulation speed and duty cycle. Such a precision facility is usually associated with studio equipment and has not been incorporated into a pedal before.

In some embodiments, the invention provides a capability allowing synchronizing the timing or tempo of the modulation to an external source. For example, the device can be synchronized using a Musical Instrument Digital Interface (MIDI) input signal. MIDI represents at least one means by which musical instruments can communicate with each other. MIDI sync is a timing signal provided by a MIDI output device to enable multiple electronic instruments to synchronize tempo. MIDI has been used to sync devices for some time, but until now there has not been a modulator pedal that allows the modulation frequency to be synchronized to a MIDI sync code. This is advantageous because many bands today use MIDI to control events and tempos. Thus, it is important for an oscillating device, such as the CHOPPER, or any tremolo unit, to be synchronized to a tempo.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The invention provides a foot pedal musical effects device for providing new and varied sound effects in a compact foot-operable package to allow a musician to vary the effects in a creative and expressive manner during the course of a performance. The device modulates an audio input signal according to one or more presets and varied position of a foot treadle.

Figure 1:
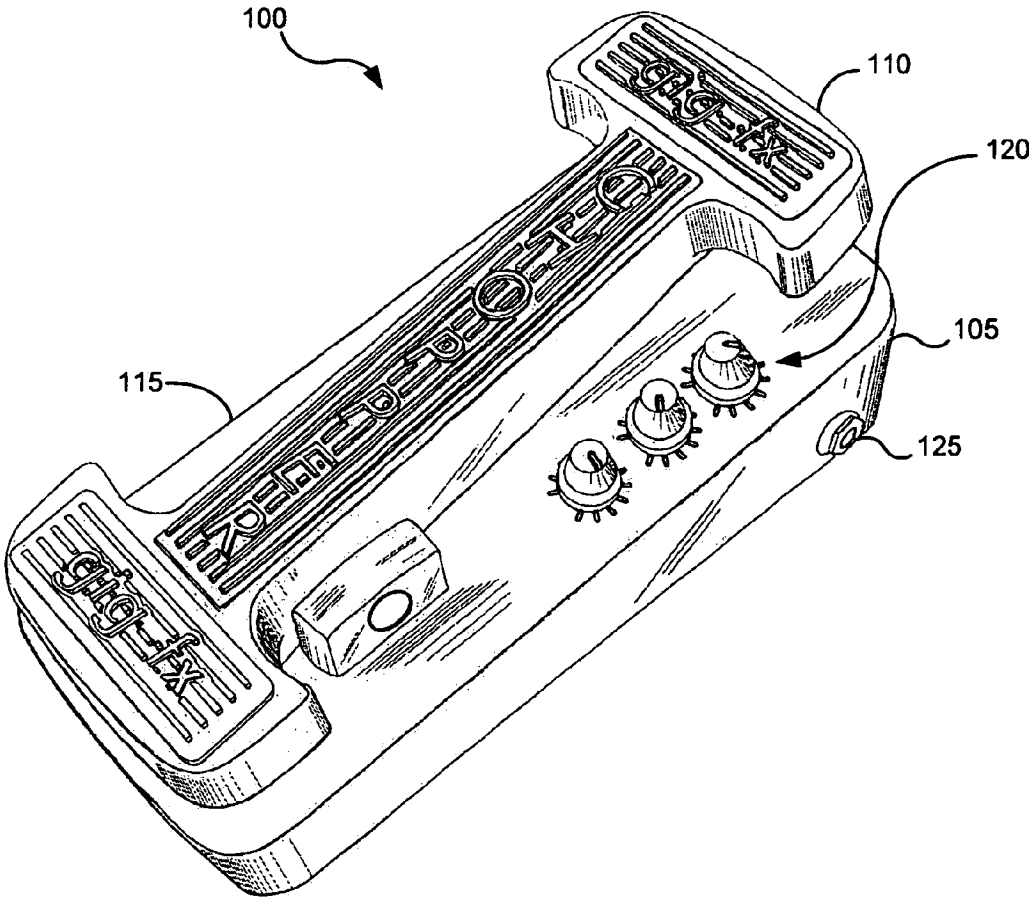
FIG. 1 is a perspective view of one embodiment of the invention illustrating the structural layout and detail of the pedal.

FIG. 1 illustrates one embodiment of a foot-operated effects pedal that provides a stable platform for foot-controlled operation, while also accommodating other controls in a compact package. As illustrated the effects pedal 100 includes an electronic housing 105 adapted to contain related electronic circuitry and an optional internal power source (not shown). The housing 105 provides a top surface 115 that generally faces the musician during use (i.e., it's the top of the housing when placed on the floor). The pedal 100 also includes a foot-operated treadle 110 disposed along the top surface 115 and pivotally coupled to the housing 105. One or more manual controls 120 and/or displays are also disposed on the top surface 115. Additionally, the electronics housing 105 may contain one or more connectors 125 to accommodate signal input and output as well as external power.

As illustrated, the treadle 110 is constructed having a unique 'I' shape well adapted to accommodate the control knobs 120, without extending the dimensions of the housing. Additionally, due to the placement and depth of the treadle 110, a user's foot can operate the treadle 110 without interfering with the control knobs 120. That is, as the treadle 110 is pivoted up and down about a pivot point, a foot placed on top of the treadle 110 will not interfere with the control knobs 120.

Such a configuration of the treadle 110 conserves a considerable amount of space thereby allowing for a more compact pedal 100. There is no reason why the treadle 110 is limited to an 'I' shape. Other shapes could also work such as a squared 'C' shape or even a 'T' shape. Preferably, the treadle 110 provides a longitudinal support member adapted for alignment with the longitudinal axis, or length of a user's foot. It is the longitudinal support member that is adapted to pivot back and forth above the housing 105. Generally, at least a portion of the longitudinal member is substantially narrower than a user's foot to accommodate for placement of the control knobs. To provide stabilization for a foot placed upon the treadle 110, a lateral support member is fixedly attached to the longitudinal member. Thus, the lateral support can be the horizontal component of an I, square C, or T; whereas, the longitudinal member can be the vertical member of each shape.

Figure 2:
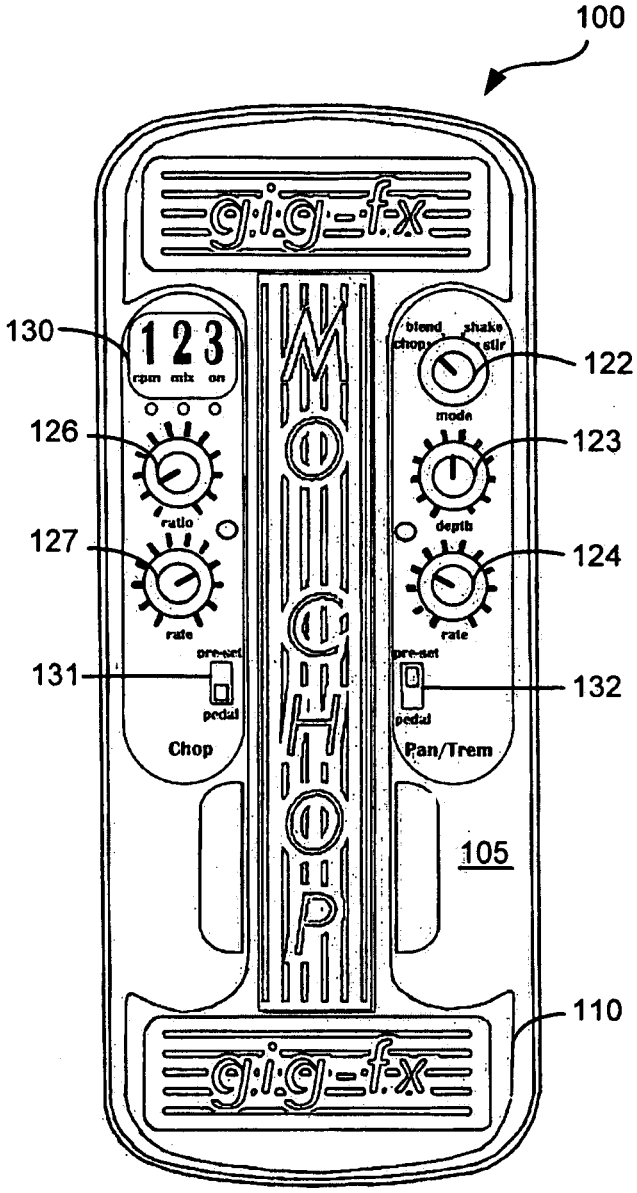
FIG. 2 is a plan view of the embodiment of the pedal shown in FIG. 1 further illustrating the structural features of the treadle and control knob placement, as well as the LCD read out screen.

The invention relates to especially-shaped treadle adapted to accommodate top-mounted controls in this manner. FIG. 2 illustrates a plan, or top view of the pedal 100 of FIG. 1, showing an exemplary layout of control knobs. The top surface 115 of the housing 105 contains a mode-selection control 122, that can be rotated to different positions to select a desired operating mode of the device 100. Other controls include a modulation depth control switch 123, a pan ratio control switch 124, a chop ratio or duty-cycle control switch 126 and a chop frequency control switch 127. The control knobs 122, 123, 124, 126, and 127 can be used to pre-set one or more of the desired feature; whereas, the treadle 110 can be used to continuously vary other features during play. In some embodiments, the pedal 100 includes one or more switches 131, 132 for selecting whether the desired feature is controlled according to the presets or by the treadle 110, thereby providing additional flexibility to the user. In some embodiments, the pedal 100 also includes a display providing the user with feedback as to one or more of the features of the pedal.

It can be clearly seen that the controls 122, 123, 124, 126, 127, 131, 132 are "nestled" within the overall space occupied by the foot treadle 110. Additionally, the depth of the treadle 110 and/or its placement above the top surface 115 ensure that an operator's foot will not interfere with the controls either. The space-saving of this design is by no means insignificant. For example, if the control knobs 122, 123, 124, 126, 127 and switches 131, 132 and LCD screen 130 were to be accommodated outside of the treadle area, the overall size of the pedal 100 would be substantially larger, making it more cumbersome, heavier, and very likely more expensive. Usually, foot pedals like the CHOPPER are placed on boards with other pedals, so if one is oversized, the whole board has to be made bigger to accommodate it, or there is less space available for other pedals. Many traveling musicians try to reduce the size and weight of the equipment they carry around, and the design of the CHOPPER allows that.

As shown in FIG. 2, the LCD read-out screen or display 130 allows for monitoring and control of features such as the modulation frequency. In some embodiments, the display 130 can be adjusted to read the frequency of either the Chop wave or the Sine wave (tremolo or pan rate), or both.

Generally, the device provides at least two oscillating waves. A first wave can be a square wave providing a capability for modulating an audio signal between two amplitude states, such as an "on" state and an "off" state. By the nature of the square wave, the audio signal is repeatedly switched or modulated between the two amplitude states at a variable and selectable rate. The modulation between the ON and OFF states is referred to herein as a "chopped" effect. The rate at which the signal varies between the two states is the modulation frequency, referred to herein as a "chop frequency." A second wave can be a sine wave providing a capability for modulating an audio signal between two amplitude states in a continuous and varied manner, as according to a sine wave. Although square and sine waves are described herein, it is conceivable that other wave forms, such as saw-tooth, triangular may also be used.

The input signal can be an electrical audio signal from an electrified instrument, such as an electric guitar. Alternatively, or in addition, the input signal can be obtained from any instrument or source providing an electrical signal, such as a keyboard, or even a signal from an acoustic source, such as that provided by a vocal microphone or instrument transducer.

Figure 3:
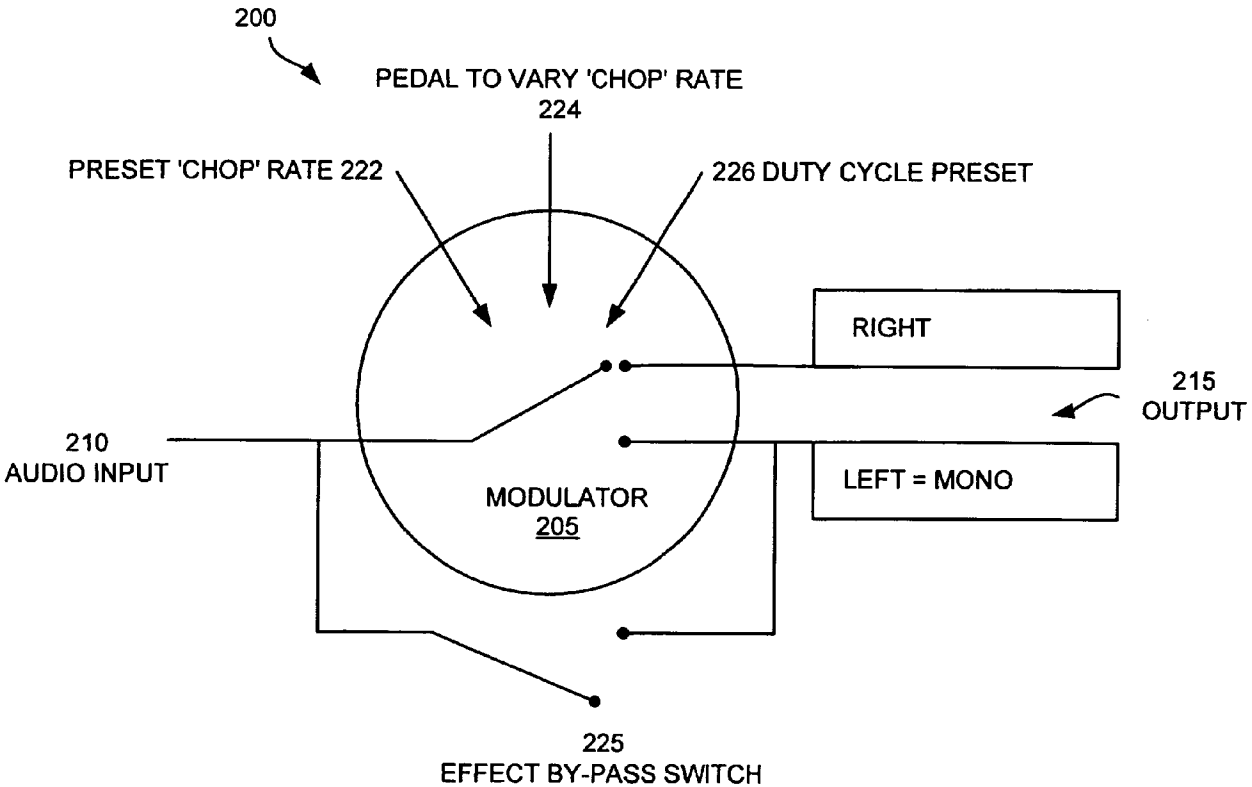
FIG. 3 is a schematic diagram illustrating how a CHOP sound is produced.

As shown in FIG. 3, a CHOPPER device 200 includes an audio input 210 for receiving an incoming or input musical signal from an external musical source. The device 200 processes the received signal using an internal modulator 205 resulting in the chopped effect, and provides an outgoing, or output "chopped" signal at an audio output 215. The modulator 205 is controllable by one or more controls 222, 224, 226. For example, a chop rate can be adjusted using a chop-rate preset switch 222. Alternatively the chop rate can be adjusted using a foot-operated treadle 224. In some embodiments, a duty-cycle control preset 226 is also provided to adjust the duty cycle defined by the ON-OFF periods. As described in more detail below, the audio signals can be mono or stereo. In some embodiments, the device 200 includes a bypass switch 225 to selectively pass the received audio input signal through the device to the audio output 215 substantially unaffected.

In operation, the device 200 generates the chopped signal by modulating the input signal between ON and OFF states. The modulation can be accomplished using analog circuitry, digital circuitry, or a combination of both analog and digital circuitry. In addition to modulating the signal, other signal-conditioning circuitry can be included. For example, the device 200 can provide impedance matching between different audio sources. Alternatively, or in addition, the device 200 can include filters to selectively alter the processed signal. Still further, this device 200 can be combined with one or more other effects, such as echo, distortion, chorus, phaser, flanger, wah, harmonizer, etc.

When adjusting the chop frequency using the chop-rate preset control 222, the treadle 224 can be used as an on-off (i.e., bypass) switch. In a stereophonic application, the chopped signal can be set to oscillate between the two channels. This feature is referred to as "panning" as the audio output signal varies between the channels in a manner as controlled by panning controls. Another adjustment can be provided for changing the duty cycle, or ratio of "on" time to "off" time. Such variability in duty cycle allows for an emphasis of the "chop" resulting in the generation of some unique sound effects.

Referring again to FIG. 2, the mode selector switch 122 provides for selection among different modes of operation. For example, the different modes produce different respective sound effects, such as CHOP, BLEND, SHAKE and STIR modes described in more detail below.

In 'chop' mode, the audio signal is chopped (turned on and off) at a rate set either by the pre-set knob 127 or by the variable foot treadle 110 allowing the user to change the chop frequency at will (i.e., "on the fly") during the course of a performance. When used in stereo, the chopped sound can be configured together with a pan between left and right channels. By combining one or more of the chop and pan modulations with the pedal-adjusted variable frequency, ground breaking new effects are produced.

Another feature of the chop mode referred to above is the adjustable 'duty cycle.' The duty-cycle adjust changes the ratio of 'on' time to 'off' time thereby determining the nature of the resulting sound. A short 'on' time makes a dramatic chop sound whereas balancing the durations of the on and off periods to be similar, the effect is more melodic.

Figure 4A:
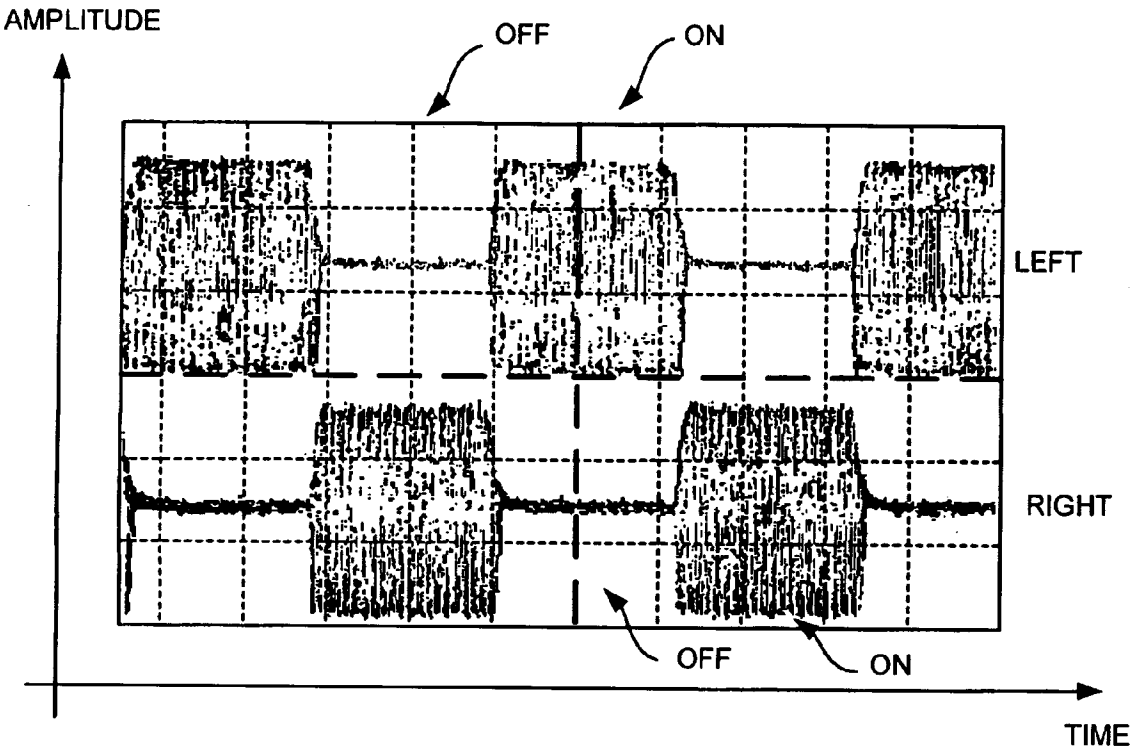
FIGS. 4A-C are waveform diagrams illustrating exemplary chopped output signals produced by one embodiment of the invention.

A typical stereo chop-mode waveform captured from an actual oscilloscope trace is illustrated in FIG. 4A. The top trace represents the left audio output signal channel; whereas, the bottom trace represents the right audio output signal. As shown, the left channel may be off at one instant of time, while the right channel is on. Conversely, the left channel may be on at another instant of time, while the right channel is off. In this manner, the sound can be chopped between the two channels of a stereo output, resulting in sound coming from only one of the two channels at any give instance of time. As the duration of the on and off periods are about equal, it is said that the duty cycle is about 50%.

Figure 4B:
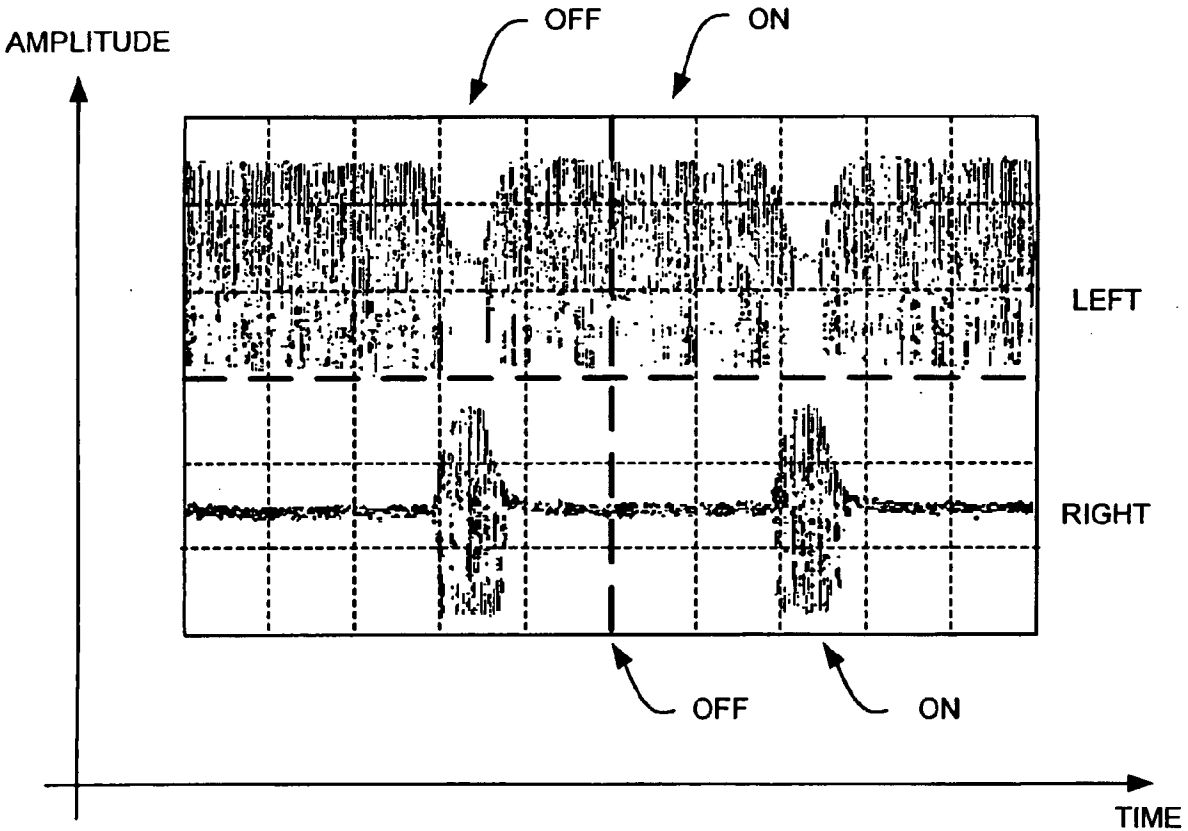

Another similarly-captured stereo chop-mode waveform is provided in FIG. 4B illustrating a different duty cycle. The resulting waveform can be produced by adjusting the ratio control 126 towards one direction giving an unequal duty cycle. Thus, as shown, one channel may have an ON signal applied for one time period, whereas the other channel has a corresponding ON signal a shorter time period. In some embodiments, the duty cycle is pre-settable between 0% and 100%. In other embodiments, the duty cycle is variable.

Figure 4C:
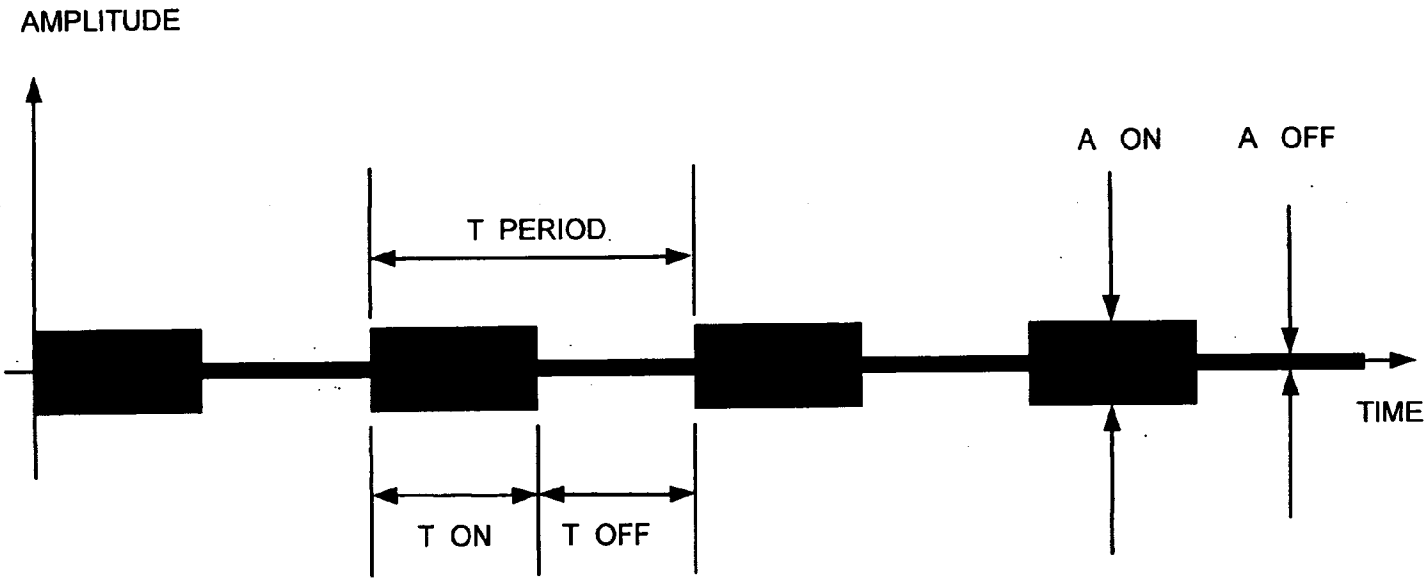

As further illustrated in FIG. 4C, the audio output signal includes ON and OFF states corresponding to ON and OFF amplitude, or signal levels. The ON signal level ($A_{on}$) can be the natural signal level of the received musical signal. The OFF signal level ($A_{off}$) typically represents a lower signal level. In some embodiments, the OFF signal corresponds to a substantially zero signal level. In practical systems, it is difficult to achieve a zero signal level as there usually remains some residual noise due to the electronics of the device as well as other external factors. Nevertheless, the OFF level may be substantially imperceptible to a listener. As also shown in this figure, a chop period can be defined as the time between the beginning of one ON signal and the beginning of the next adjacent ON signal. A chop rate can be defined as the inverse of the chop period (i.e., $1/T_{period}$).

The electronic circuitry used to cause the musical signal to be turned on and off repeatedly can either be "analog" (i.e., the musical signal is turned on and off by means of circuitry directly in the signal path), or "digital," where the analog musical signal is first converted to a digital signal by means of an Analog-to-Digital (A-D) converter. Thus, in a digital application, the bit stream is processed to achieve the on/off effect at the rate and duty cycle as set by the user. The chopped digital signal can then be converted back to an analog signal using a Digital-to-Analog (D-A) converter, thus giving the same chopped effect.

Figure 5:
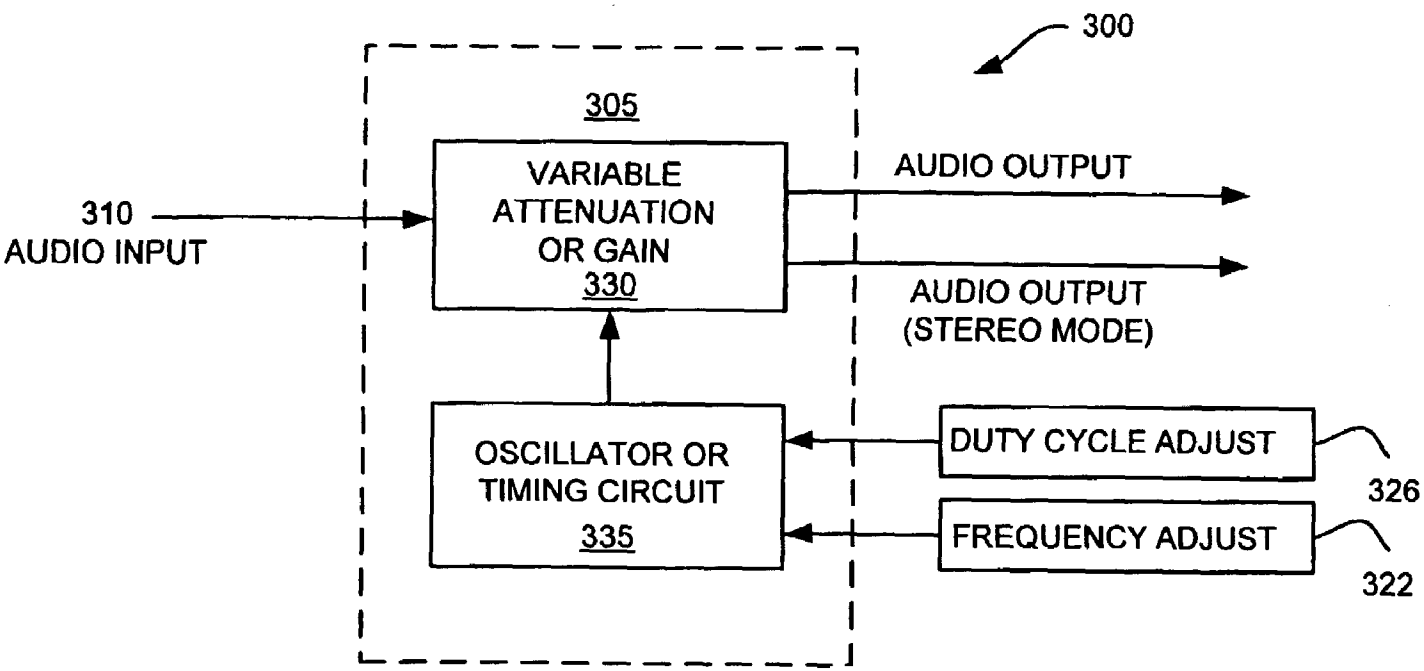
FIG. 5 is a schematic block diagram of a representative embodiment of the invention having electrical circuitry configured to generate a chopped signal.

For analog embodiments, the on-off effect can be generated as shown in FIG. 5. The device 300 includes a modulator 305 receiving an audio signal at its audio input 310 and providing a modulated audio output at its audio output 315. The modulator can include an amplitude-adjusting circuit 330 receiving the audio input signal and adapted to adjust its amplitude between at least two different levels (e.g., on and off), providing a modulated audio output signal. The amplitude-adjusting circuit 330 receives a control input from an oscillating or timing circuit 335. The timing circuit 335, in turn, is adjustable according to one or more user-adjustable controls. For example, the timing circuit 335 receives a first input from a duty-cycle adjust 336 and a second input from a frequency adjust 322.

A chopped effect can be produced by the modulator repetitively attenuating (i.e., decreasing) and then un-attenuating (i.e., increasing) the electrical level of the audio input signal by the same amount. This can be achieved by actively reducing and then increasing the impedance to signal ground seen by the signal. Alternatively, or in addition, the on-off effect can be achieved by increasing and then decreasing the impedance in the signal path, by repetitively reducing and then increasing electrical gain in the signal path, or by a combination of increasing and then decreasing the impedance and gain in the signal path. The repetition rate for the signal attenuation can be controlled by one of many possible oscillator circuits 322. Duty cycle, defined by "on time" and "off time" (signal/no signal time intervals), is controlled by means of the position of the duty cycle control knob 326. Duty cycle is determined by the ratio of ON/OFF time periods in the timing signal generated by the oscillator and applied to the variable attenuation circuitry.

As described above, the output signal may be mono or stereo. If stereo, the effect can be panned or "chopped" from one channel to another in various ways. For example, two stereo outputs (i.e., Channel 1 and Channel 2) can be chopped alternately, with each being substantially 180° out of phase with the other. In this manner, the sound can be chopped between the two channels, resulting in sound coming from one of the two channels at any give instance of time.

Figure 6:
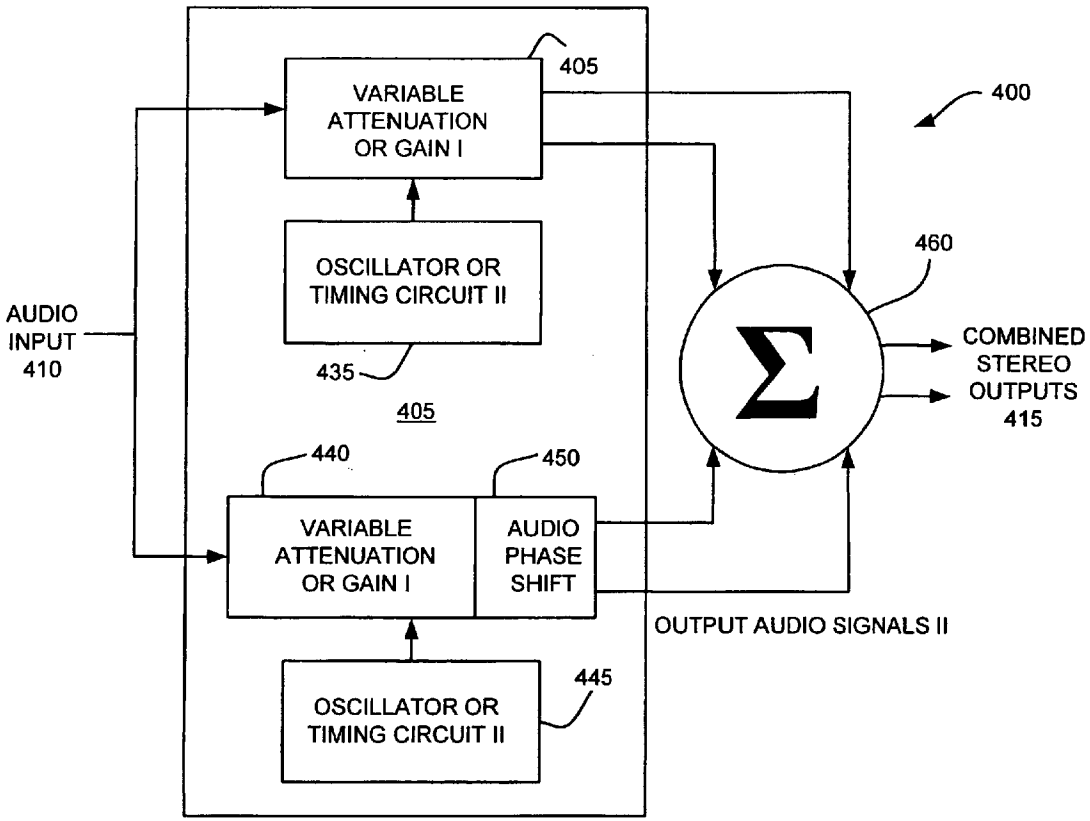
FIG. 6 is a schematic block diagram of an alternative embodiment of the invention having electrical circuitry configured to generate and combine chopped signals.

Alternatively or in addition, the input signal may be split and applied to two or more variable rate attenuation circuits, the output of the attenuation circuits being summed in parallel, or applied to two variable rate attenuation circuits in series. One embodiment of such a configuration is illustrated in FIG. 6. The device 400 includes a modulator 405 receiving an audio signal at its audio input 410 and providing a modulated audio output at its audio output 415. The modulator 405 includes a first amplitude-adjusting circuit 430 controlled by a first timing circuit 435 and a second amplitude-adjusting circuit 440 controlled by a second timing circuit 445. The input signal is split and applied to both amplitude-adjusting circuits 430, 440 in parallel. The output of the second amplitude-adjusting circuit 440 is routed through an audio phase shifter 450 and combined with the output of the first amplitude adjusting circuit 430 in a signal combiner 460.

The multiple chopped or amplitude modulated audio signals can be summed or combined in various ratios and phase relationships to produce various 'delay emulation' effects by varying the settings of the respective amplitude-adjusting circuits 430, 440 and/or timing circuits 435, 445. Such variability includes varying the relative phase of one or more of the audio signals before recombining with the other signals.

In some embodiments, the device includes an operational mode referred to as a "blend" mode. This is one form of 'delay (echo) emulation'. In blend mode, the two waves are combined. When used in stereo, the sound produced is similar to that which is produced by a 'delay' pedal but with the absence of a repeated note, the pedal can achieve the melodic effect of a delay pedal but without the limitation of a repeated note hanging on. The sound produced is melodic in context and can be pulsating and rhythmic.

Figure 7:
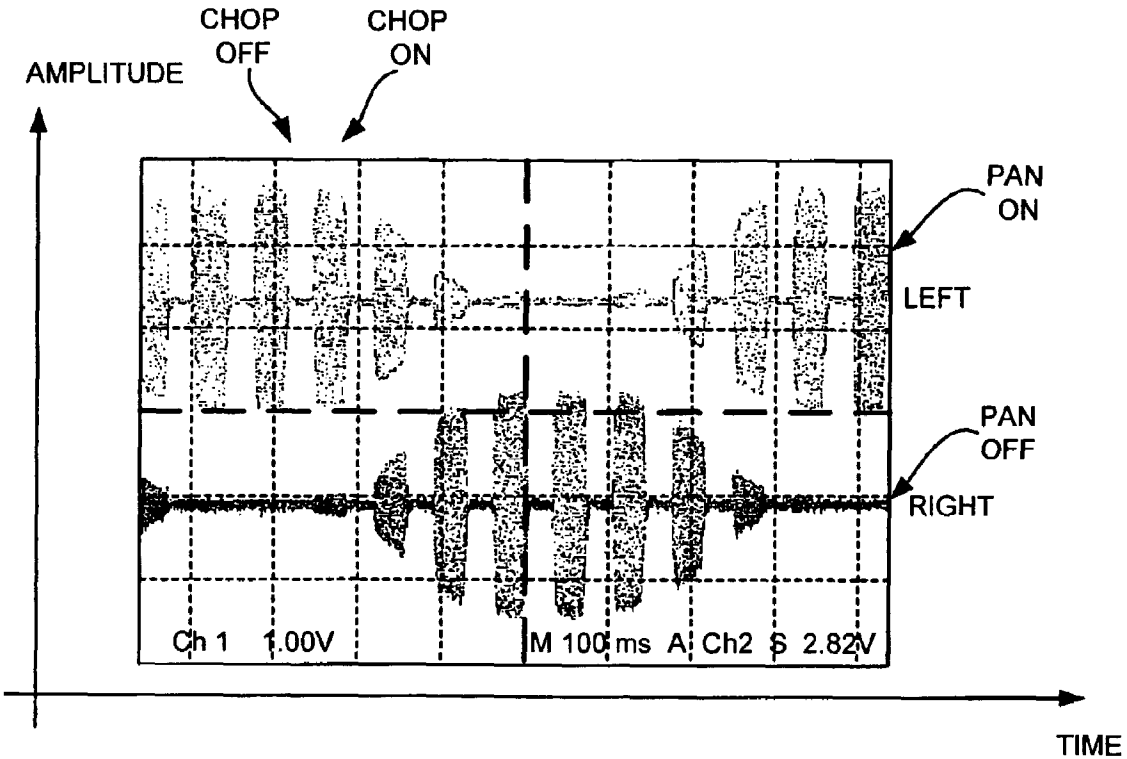
FIG. 7 is a waveform diagram illustrating exemplary left and right channels of a blend-mode waveform produced by one embodiment of the invention.

A typical stereo blend-mode waveform captured from an actual oscilloscope trace is illustrated in FIG. 7. Once again, the top trace represents the left audio output signal and the bottom trace represents the right audio output signal of a stereo output. As shown, the left channel may be off at one instant of time, while the right channel is on. However, the transition between off and on states is smooth providing some overlap. That is, as the amplitude of one channel is decreasing, the amplitude of the other channel is increasing. As illustrated, this panning effect can be controlled by a sine wave. Additionally, each of the channels is also chopped. As illustrated, the chop rate is substantially faster than the pan rate, such that several chop periods are represented within each one period of the pan cycle. Thus, in the blend mode, the chopped effect can be allocated to the left and right channels and panned at the same time. Additionally, the chop duty cycle (ratio) adjustment can be adjusted or varied to add to the drama by making the chops shorter.

In some embodiments, the chopped signal can be subsequently fed into one or more other effects, such as an auto-wah or synth-wah envelope filter to produce even more interesting effects.

In some embodiments, the device is can operate in what is referred to as a "shake" mode. In this mode, the outputs of the different amplitude-adjusting circuits (e.g., the square and sine waves) are combined out of phase with respect to each other to provide a melodic and complex sound that captures the creative imagination. It is akin to a series of echoes with different time intervals, totally unique and never-before-heard in a sound effect. The chop frequency and pan frequency can be set to produce extremely rhythmic patterns and can be followed by other event-triggered effects to create new sounds.

Figure 8:
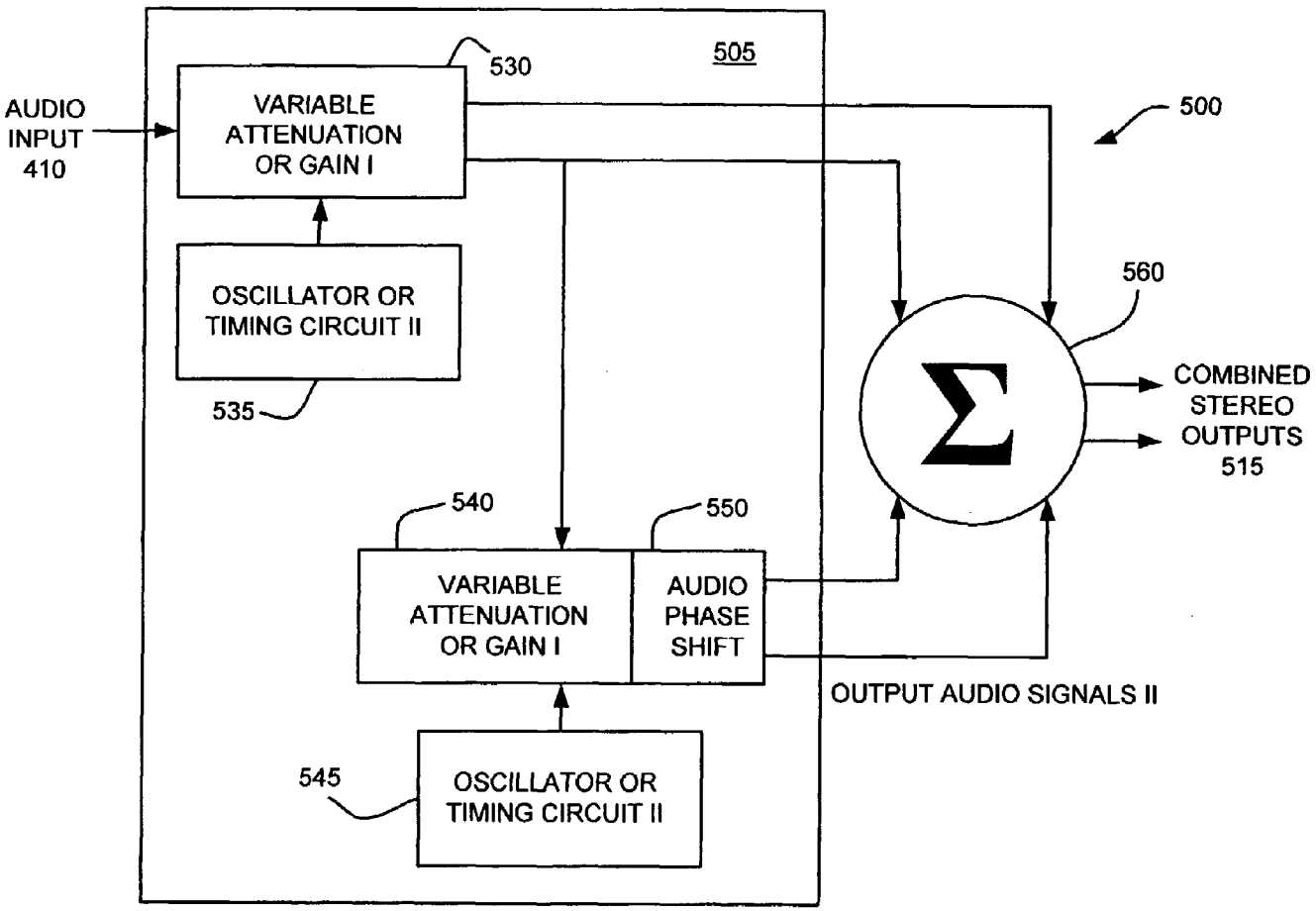
FIG. 8 is a schematic diagram of an embodiment of the invention adapted to produce a delay emulation sound effect.

An alternative embodiment of the device is adapted to apply an audio signal to two consecutive variable attenuation or gain stages and sum the outputs in parallel with at least one signal is phase shifted with respect to the other is illustrated in FIG. 8. The result, depending upon the actual settings, is an on-off rhythm sound pattern. The device 500 includes a modulator 505 receiving an audio signal at its audio input 510 and providing a modulated audio output at its audio output 515. The modulator 505 includes a first amplitude-adjusting circuit 530 controlled by a first timing circuit 535 and a second amplitude-adjusting circuit 540 controlled by a second timing circuit 545. The input signal applied only to the first amplitude-adjusting circuits 530. The input to the second amplitude-adjusting circuit 540 is provided by the output of the first amplitude-adjusting circuit 530. The output of the second amplitude-adjusting circuit 540 is routed through an audio phase shifter 550 and combined with the output of the first amplitude adjusting circuit 530 in a signal combiner 560.

Figure 9:
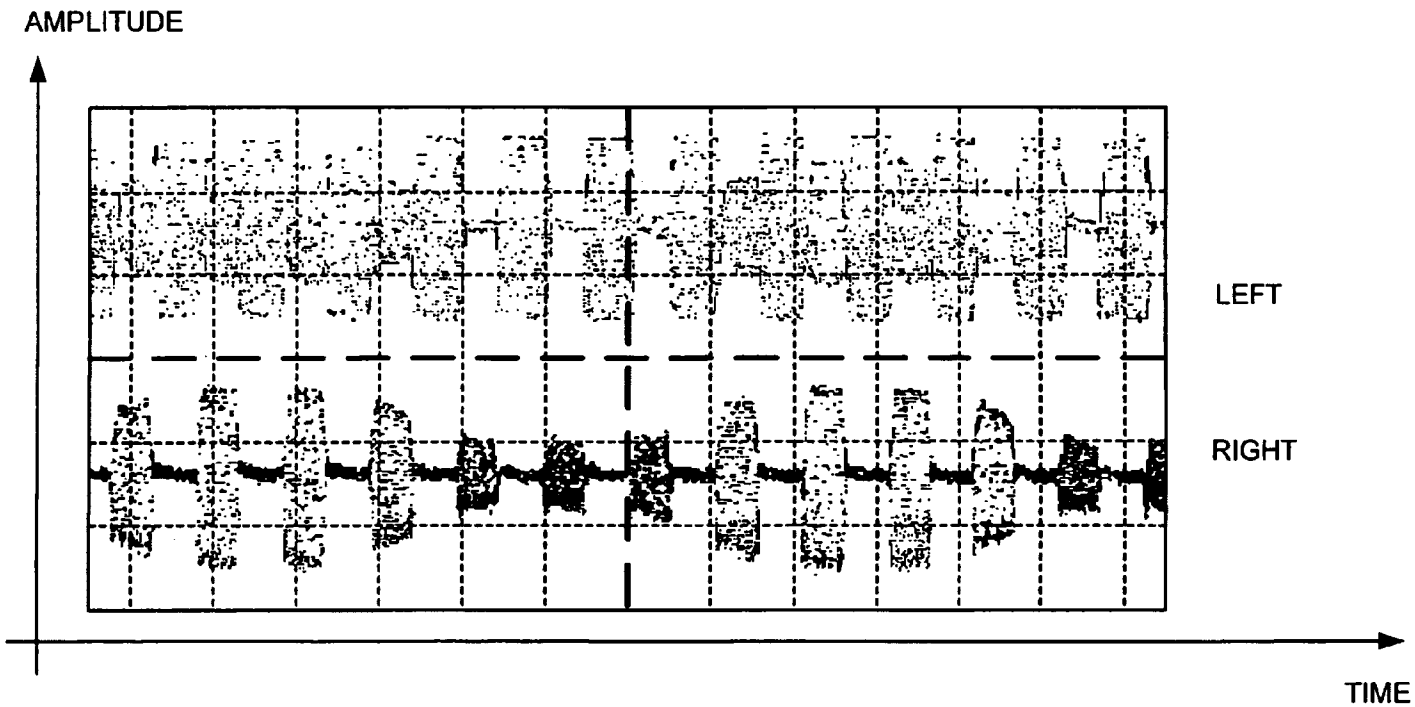
FIG. 9 is a waveform diagram obtained using an oscilloscope capture of exemplary delay emulations produced by one embodiment of the invention.

An exemplary shake mode delay emulation waveform captured from an actual oscilloscope trace is illustrated in FIG. 9. As illustrated, the device 500 inserts partial amplitude out of phase chop ON signals into the chop OFF period at a slower pan rate in the left channel and adds two in phase chop signals in the right channel. A degree of randomness is achieved by allowing the two oscillators 535, 545 to run unsynchronized with respect to one another. In some embodiments, the two oscillators can be synchronized with respect to each other.

In a digital embodiment of the CHOPPER pedal, the different waveform patterns can be defined by programming ON and OFF times and phases by means of software. As in the analog version, both the chop and pan frequencies can be varied, thus creating either random or predetermined intervals, but in addition, the ON times and OFF times can be programmed to specific patterns whether the effect is used in mono or stereo. For example, the ON periods could be programmed to be: slow-slow-slow-pause-quick-quick, or any other pattern the user wants to create.

Using these effects, an instrument, such as the guitar, can be turned into a pattern generator creating funky and rhythmic stereo sounds hitherto never achieved by means of a foot-pedal or a rack-mounted effects unit intended for electrical musical instruments.

Although a foot pedal configuration is described herein, the device can also be packaged in any one of a various number of alternative configurations. For example, the device can be configured in a rack-mounted configuration for studio or stage use. In rack mounted applications, the pedal feature is either not used or effected by means of a separate pedal controller, such as a midi-controller or a simple device similar to a volume pedal. Alternatively, the device can be configured as a self-contained, stand-alone device, such as a floor-mounted option with a pedal provided on top of the housing for placement at the performer's feet.

Figure 10A:
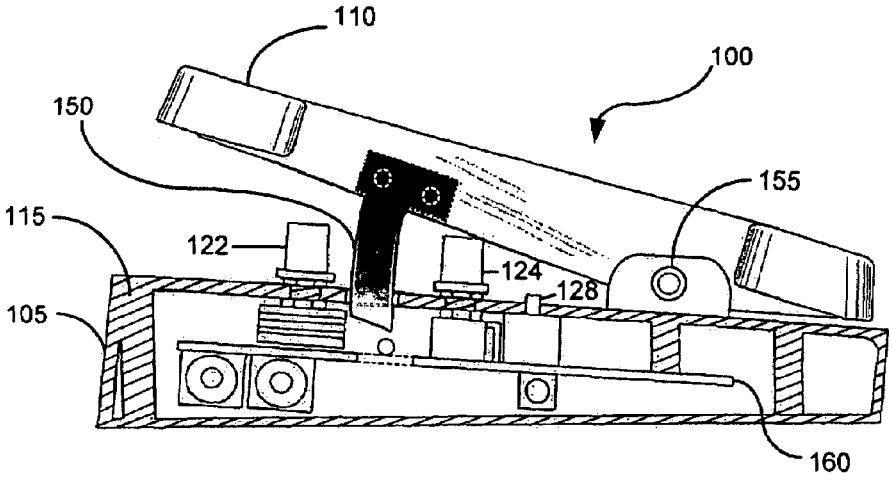
FIGS. 10A and B are cross-sectional diagrams of the pedal of FIG. 1 illustrating the treadle in an "up" position and in a "down" position, respectively.
Figure 10B:
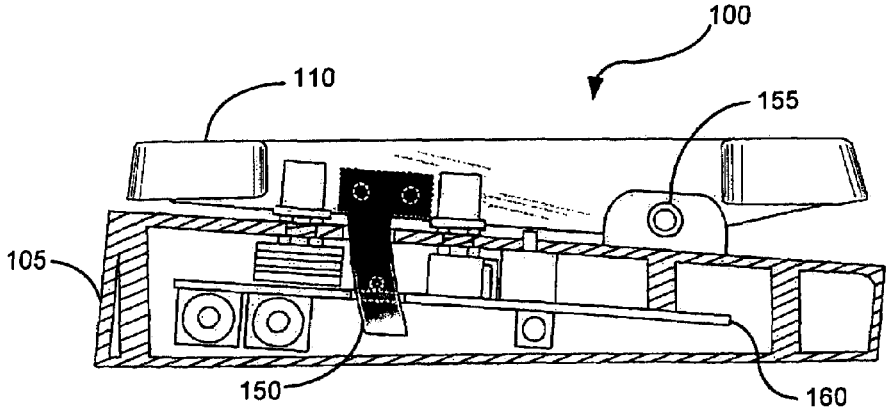
Figure 11:
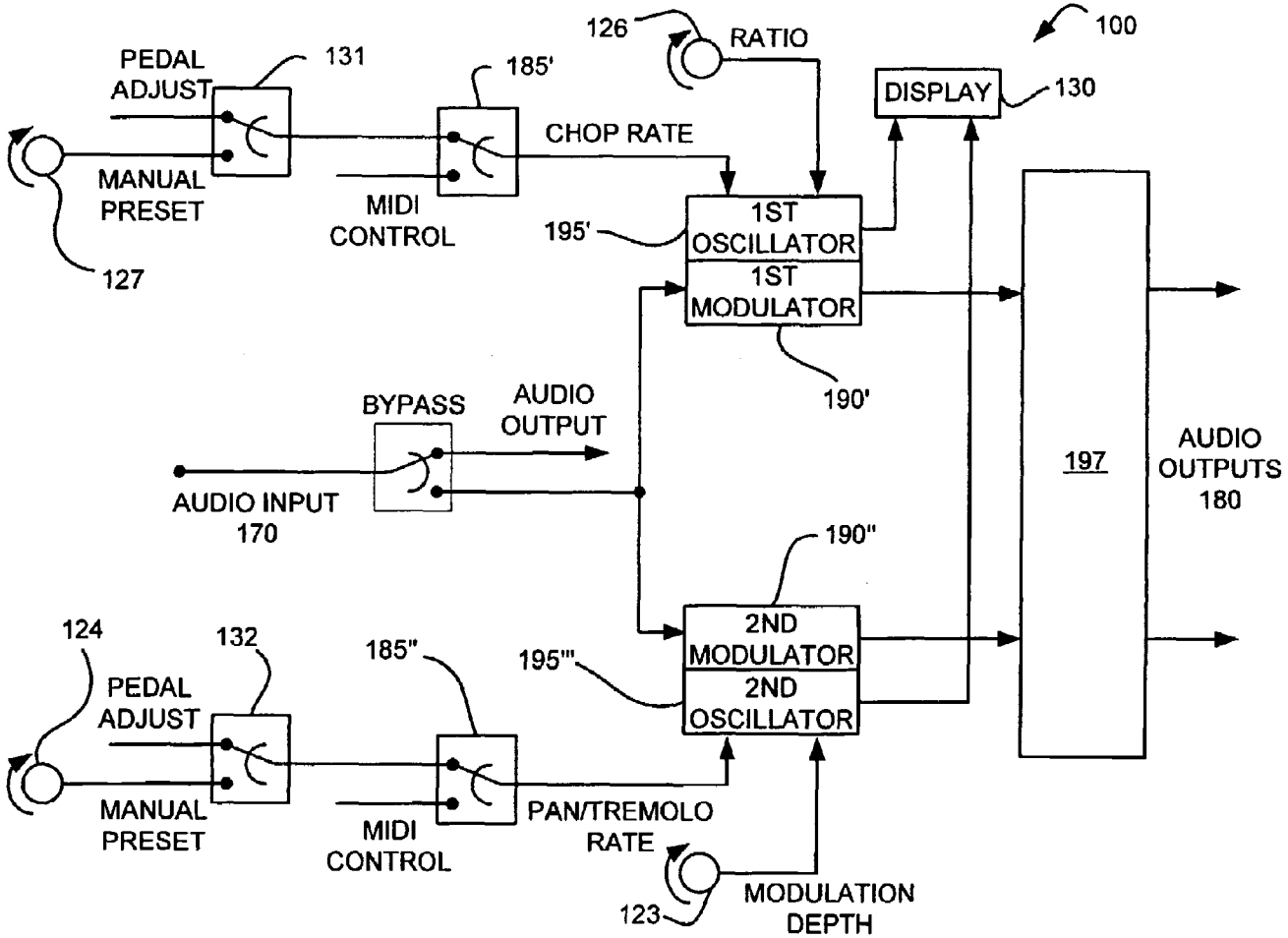
FIG. 11 is a schematic diagram of one embodiment of one embodiment of the invention illustrating interconnection of the controls and switches.

In some embodiments, as cross-sectionally illustrated in FIGS. 10A and B, the pedal action is provided by a pivoting member or treadle 110 shown in up and down positions, respectively. The pedal 100 includes a treadle 110 pivotally attached to an electronics housing 105 at a pivot 155. Thus, the treadle 110 can be pivoted between a full up position as shown in FIG. 10A and a full down position as shown in FIG. 10B. Advantageously, the treadle 110 does not interfere with the control knobs and switches 122, 124, 128. The treadle is coupled to internal circuitry 160 through a linkage 150. Thus, the position of the pedal as communicated to the internal circuitry 160 through the linkage 150, can be used to control one or more features provided by the device 100.

In operation, movement of the treadle 110 varies a control parameter in the electronic circuitry according to the position of the treadle. The linkage 150 between the treadle and the electronic circuitry can be any suitable linkage, such as a mechanical linkage as shown or an optical linkage. Thus, the linkage 150 provides a particular control signal to the electronics depending on the position of the treadle 110. Preferably, the treadle 110 provides a neutral mechanical bias allowing the it to remain, without the application of additional force, in the position last set. It is conceivable, however, that in other embodiments the treadle can be biased in a preferred position (e.g., full open).

The chop rates and pan rates (frequencies) can be simultaneously adjusted by means of the same treadle 110 by the performer's foot without the performer having to remove hands from the instrument. It is believed to be the first time such a foot pedal has been designed to manipulate multiple modulation parameters (i.e., two separate oscillating waves) in this way.

In an exemplary embodiment of a stereophonic device, the chopped signal can also be panned between left and right channels alternately at a rate or in a manner set by the pedal 100. The pan rate can be varied over a frequency range from a relatively slow pan of about 0.3 Hz, to much faster pan rates of 15 Hz or even greater. The pan frequency can be controlled (in a continuously variable manner) by the user's foot allowing the user to play continuously with a tremolo and/or pan effect rate without using hands. In a stereo system, this foot-operated adjustment is believed to be unique.

In some embodiments, additional features, such as a visible display 130 (FIG, 2) are provided to display one or more settings of the device 100. For example, the display 130 can identify the oscillator frequency in order to facilitate control of one or more of the device parameters. Any of a number of conventional circuits can be provided to determine the oscillator frequency. For example, a detection circuit that triggers of the oscillator output, e.g., at its rising edge, uses the trigger points to determines the corresponding frequency. The frequency, once determined, can be displayed in terms of Hz (bits of cycles per second), or CPM (chops per minute). When the device is synchronized using a MIDI signal, the display 130 can be configured to show the MIDI sync rate (e.g., in beats per minute). For LCD displays, the foot pedal allows for the display to be back-illuminated, if required.

In some embodiments, the chop frequency can be synchronized using an external signal or trigger such as that provided by a MIDI signal. Such synchronization can be applied to analog, digital, and mixed analog and digital embodiments. The MIDI synchronization is achieved by allowing the MIDI timing signal to trigger the first (e.g., square wave) oscillator so that it can be synchronized with an external beat or signal provided from an external source by means of a connecting cable. The timing signal can be connected directly to the oscillator in order to achieve synchronization with the internal timing source being disconnected in the presence of the external sync signal. MIDI has been used before to time events and to provide a sync signal, but this is the first time it has been used to synchronize an oscillating frequency in a foot pedal.

An exemplary schematic diagram illustrating the interconnections of the control switches is illustrated in FIG. 1. An audio input signal is received at an audio input 170. The signal is routed through a bypass switch 175 that can be operated to direct the input signal through the device 100 or directly to an audio output 180. The input audio signal, if not bypassed, is routed to one or more modulators 190', 190", each modulator being controlled by a respective oscillator 195', 195". The output of each of the oscillators 195', 195" is routed to a display unit 130. The output of each of the modulators 190', 190" is routed to an interconnection circuit 197 that routs the signals, as determined by the selected mode, to the audio output 180. For example, the interconnection circuit may include a phase offset and/or a signal combiner.

The first modulator 190' is controlled by a chop rate input. The chop rate can be obtained from an external MIDI signal or from settings of the device 100 as determined by a first MIDI control switch 185'. A first pedal/preset switch 131 selects whether the chop rate control is obtained from the treadle 110 or from the manual preset 127. The second modulator is similarly controlled by a pan/tremolo rate input. The pan/tremolo rate can be obtained form an external MIDI signal or from settings of the device 100 as determined by a second MIDI control switch 185". A second pedal preset switch 132 selects whether the pan/tremolo rate control is obtained from the treadle 110 or from the manual preset 124. Additionally, the first oscillator 195' receives an input from a chop ratio preset 126 and the second oscillator 195" receives an input from a modulation depth preset 123.

While this invention has been particularly shown and described with references to preferred embodiments thereof, it will be understood by those skilled in the art that various changes in form and details may be made therein without departing from the scope of the invention encompassed by the appended claims.

What is claimed is:

1. An electronic musical effects apparatus comprising:

a housing with a top side;

an integrated foot-operated treadle comprising an aperture, the treadle pivotally coupled to the top side of the housing and adapted to vary at least one musical effect;

at least one electronically coupled user interface coupled to the at least one musical effect and disposed on the top side of the housing and disposed at least partially within the aperture of the treadle.

2. The apparatus of claim 1, wherein the treadle comprises:

a longitudinal member adapted for axial alignment with the length of an operator's foot, at least a portion of the longitudinal member being substantially narrower than the operator's foot; and at least one transverse stabilizing member adapted to provide stable support for the operator's foot.

3. The apparatus of claim 1, wherein the treadle comprises a shape selected from the group consisting of: 'I'; 'T'; 'O'; 'C'; and 'U'.

4. The apparatus of claim 1, further comprising:

an input port for receiving a musical signal;

a first amplitude modulator coupled to the input port and adapted to modulate the received musical signal according to a first modulation rate;

a second amplitude modulator coupled to the input port and adapted to independently modulate the received musical signal according to a second modulation rate; and a combiner for combining the output signals of the first and second amplitude modulators, to thereby create an echo emulation without repeating the same note.

5. The apparatus of claim 4, and further comprising a first oscillator coupled to the first modulator and a second oscillator coupled to the second modulator, the first and second oscillators being independently adjustable.

6. The apparatus of claim 5, wherein the first oscillator provides a square wave output to the first modulator and the second oscillator provides a sine wave output to the second modulator.

7. The apparatus of claim 1, wherein the apparatus further comprises an input port for receiving a musical signal;

the apparatus further comprises a modulator coupled to the input port and adapted to modulate the received musical signal; and the user interface comprises a visible display adapted to display a modulation frequency of the modulated signal thereby allowing for precise control of the modulation rate.

8. The apparatus of claim 1, wherein the user interface comprises at least one control knob.

9. The apparatus of claim 8, wherein the treadle is coupled to the top side of the housing such that an operator's foot may pivot the treadle up and down about a pivot point without interfering with the at least one control knob.

10. The apparatus of claim 1, wherein the aperture comprises at least one cut-out that harbors the user interface nestled within the spade of the cut-out.

11. The apparatus of claim 1, wherein the treadle varies the at least one musical effect via an optical linkage.

12. The apparatus of claim 1, wherein the treadle is generally "l-shaped".

13. The apparatus of claim 1, wherein the apparatus further comprises a stereophonic output with two channels;

the at least musical effect comprises panning the musical signal between the two channels of the stereophonic output; and varying the at least one musical effect compromises varying the pan rate frequency with the integrated foot-operated treadle.

14. A musical effects apparatus comprising:

an input port for receiving a musical signal;

at least two amplitude modulators, each modulator receiving an input from a respective oscillator; and and integrated foot-operated treadle communicatively coupled to the least two oscillators, the integrated foot-operated treadle allowing simultaneous hands-free adjustment of the at least two amplitude modulators.

15. A musical effects apparatus comprising:

an input port for receiving a musical signal;

at least two modulators, each modulator receiving an input from a respective oscillator; and an integrated foot-operated treadle communicatively coupled to the at least two oscillators, the treadle allowing hands-free adjustment of at least one of the at least two modulators, wherein one of the modulators pans the musical signal between two channels of the stereophonic output whereby the pan rate frequency is controlled by the integrated foot-operated treadle.

16. The apparatus of claim 15 wherein the panel-rate control is configured to adjust the pan rate between about 0.3 Hz and about 30 Hz.

17. The apparatus of claim 15, wherein the foot-operated treadle is adapted to control the at least two modulators selected from a number of pre-determined options in which the modulated musical signal is allocated to each of the stereo channels to create an echo emulation.

18. A musical foot-pedal effect comprising:

a housing with a top side;

an integrated foot-operated treadle comprising an aperture, the treadle pivotally coupled to the top side of the housing and adapted to vary at least one musical effect;

an input port for receiving a musical signal;

a modulator coupled to the input port and adapted to modulate the received musical signal; and a visible user interface adapted to display a modulation frequency of the modulated signal, the visible user interface disposed on the top side of the housing and disposed at least partially within the aperture of the treadle.

19. The apparatus of claim 18, wherein the modulator modulates the received musical signal according to an external Musical Instrument Digital Interface (MIDI) synchronizing signal.

20. A musical effects apparatus for manipulating a signal passing therethrough comprising:

a housing with a top side;

an integrated foot-operated treadle comprising an aperture, the treadle pivotally coupled to the top side of the housing and adapted to manipulate the signal passing therethrough;

at least one electronically coupled user interface operatively associated with the signal passing therethrough and disposed on the top side of the housing and disposed at least partially within the aperture of the treadle.

* * * * *